US005807090A

United States Patent [19]

Agner

[11] Patent Number: 5,807,090

[45] Date of Patent: Sep. 15, 1998

[54] VANE PUMP HAVING A HYDRAULIC RESISTANCE ELEMENT

[75] Inventor: Ivo Agner, Bad Homburg, Germany

[73] Assignee: Luk Fahrzeug-Hydraulik GmbH & Co. KG, Bad Homburg, Germany

[21] Appl. No.: 696,806

[22] Filed: Aug. 13, 1996

[30] Foreign Application Priority Data

| | | | |
|---|---|---|---|
| Aug. 14, 1995 | [DE] | Germany | 195 29 803.9 |
| Aug. 28, 1995 | [DE] | Germany | 195 31 701.7 |
| Jun. 21, 1996 | [DE] | Germany | 296 10 896.0 |
| Jul. 20, 1996 | [DE] | Germany | 196 29 336.7 |

[51] Int. Cl.[6] ..... F01C 19/08

[52] U.S. Cl. ..... 418/135; 418/268; 418/269

[58] Field of Search ..... 418/134, 135, 418/268, 269

[56] References Cited

U.S. PATENT DOCUMENTS

| | | | |
|---|---|---|---|
| 4,386,891 | 6/1983 | Riefel et al. | 418/269 |
| 4,540,347 | 9/1985 | Child | 418/135 |
| 5,026,263 | 6/1991 | Iwata | 418/268 |
| 5,466,135 | 11/1995 | Draskovits et al. | 418/268 |

FOREIGN PATENT DOCUMENTS

| | | |
|---|---|---|
| 0 481 347 A1 | 4/1992 | European Pat. Off. . |
| 23 24 002 | 11/1973 | Germany . |
| 24 23 474 | 11/1975 | Germany . |
| 25 12 433 | 9/1976 | Germany . |
| 28 35 816 A1 | 2/1980 | Germany . |
| 32 123 63 | 2/1983 | Germany . |
| 195 29 806 A1 | 2/1997 | Germany . |

*Primary Examiner*—Charles G. Freay
*Attorney, Agent, or Firm*—Darby & Darby

[57] ABSTRACT

A pump, particularly a vane or roller pump, with at least two pump segments, each having a suction region and a pressure region, with a first fluid path leading from the pressure side to a consumer, and with at least one hydraulic resistance element, which is arranged in the first fluid path to the consumer, is proposed. The pump is characterized in that the hydraulic resistance element is arranged in a second fluid path connecting the pressure regions of the at least two pump segments.

24 Claims, 10 Drawing Sheets

VANE PUMP HAVING A HYDRAULIC RESISTANCE ELEMENT

SPECIFICATION

The invention relates to a pump, particularly a vane or roller pump. Pumps, particularly roller pumps and vane pumps of the type under discussion here, are known. For example, DE 28 35 816 A1 shows a pump with a rotor that has slits to hold vanes in its circumference wall. The rotor rotates within a contour ring, which forms at least one, in this case two sickle-shaped transport spaces, through which the vanes pass. When the rotor rotates, the spaces become larger and smaller, resulting in suction regions and pressure regions. When the contour ring has two transport spaces, there are two separate pump segments, each with one suction region and one pressure region.

If a vane pump is shut down while it is warm from operation, the vanes on top slide back into the slits in the rotor under the effect of gravity. This eliminates the separation, which the vanes otherwise bring about between the suction region and the pressure region, resulting in what could be called a short circuit in this pump segment. On the opposite side, the vanes slide out of their slits under the effect of gravity. In this pump segment, the suction region and the pressure region are separated by the vanes, which are moved out.

If the fluid transported by the vane pump, for example hydraulic oil, cools down, its viscosity increases, so that the mobility of the vanes decreases. If the pump is now put into operation, the transport output of the pump is greatly reduced in case of a cold start, because of the short circuit in one pump segment.

It is therefore the task of the invention to create a pump, which does not demonstrate these cold-start properties, or does not demonstrate them to such a marked degree.

This task is accomplished using a pump, particularly a vane pump. Because a hydraulic resistance element is provided between the pressure regions, the viscous hydraulic oil, which is being transported during the start of the pump, preferably flows into the bottom vane region, because of the lesser resistance.

It is particularly advantageous to use a seal element as the hydraulic resistance element. Since the seal element completely seals off a fluid path, it is therefore a resistance element with an infinite resistance. Because of the fact that the seal element particularly interrupts the connection of the two pressure regions with one another, here also the fluid path from the pressure side of the pump to a consumer, the hydraulic oil, which is transported during the start of the pump, is exclusively utilized for the bottom region, in other words exclusively for forcing the vanes (in the case of a roller pump; the rollers) outward into their functional position.

In a preferred embodiment of a vane pump, a fluid connection to a bottom vane region, which lies ahead of the transport opening, is first produced. This causes the bottom vane region of those vanes, which are just passing through the suction region to be acted on by a pressure. In other words, here the function of precisely that pump segment, which otherwise does not transport any hydraulic oil during a cold start is being supported.

An embodiment of a vane pump, in which the hydraulic resistance element possesses a finite resistance, is also preferred, where an adjustment of the resistance value can be achieved by means of a corresponding structure of channel or groove cross-sections.

Further developments are evident from the other dependent claims. The invention will be explained in greater detail below, on the basis of the drawings, in which FIG. 1 shows a basic diagram of a first example of a vane pump;

Figure 14:
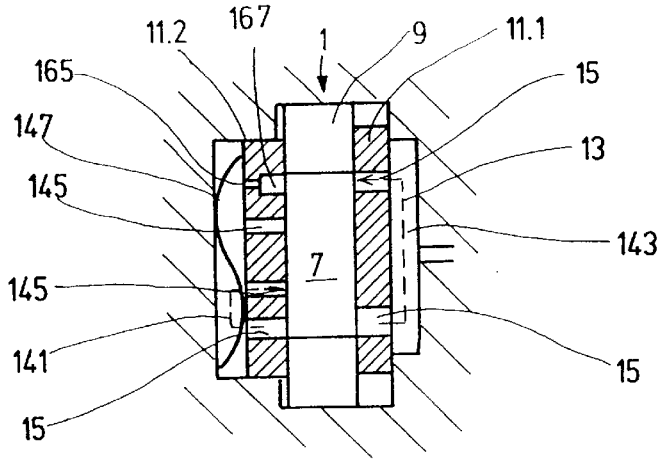
Figure 14:
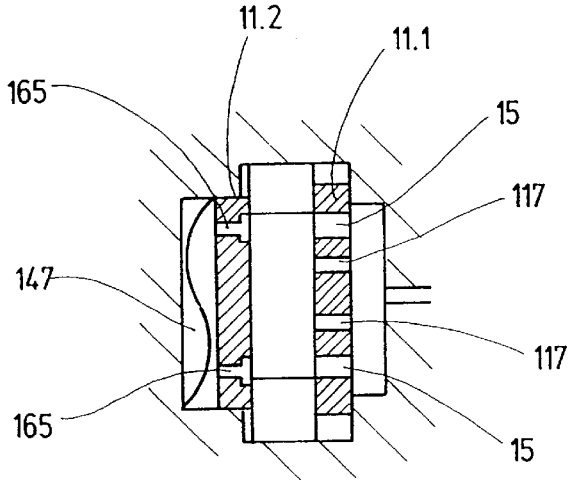
Figure 14:
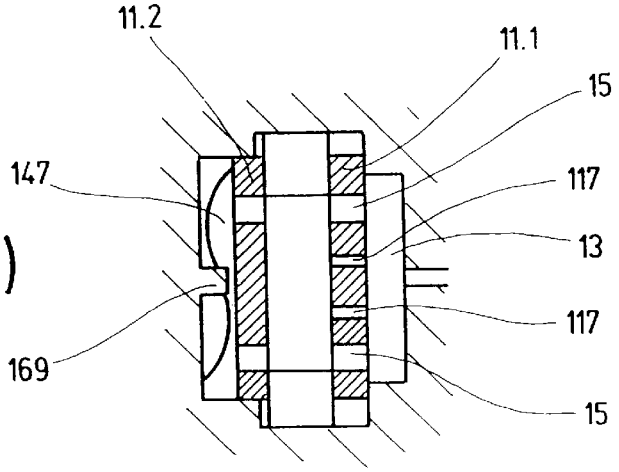

FIGS. 14*a*–14*c* show basic diagrams of other examples of a vane pump.

The invention described below relates both to vane pumps and to roller pumps. The following description proceeds from vane pumps only as an example.

Figure 1:
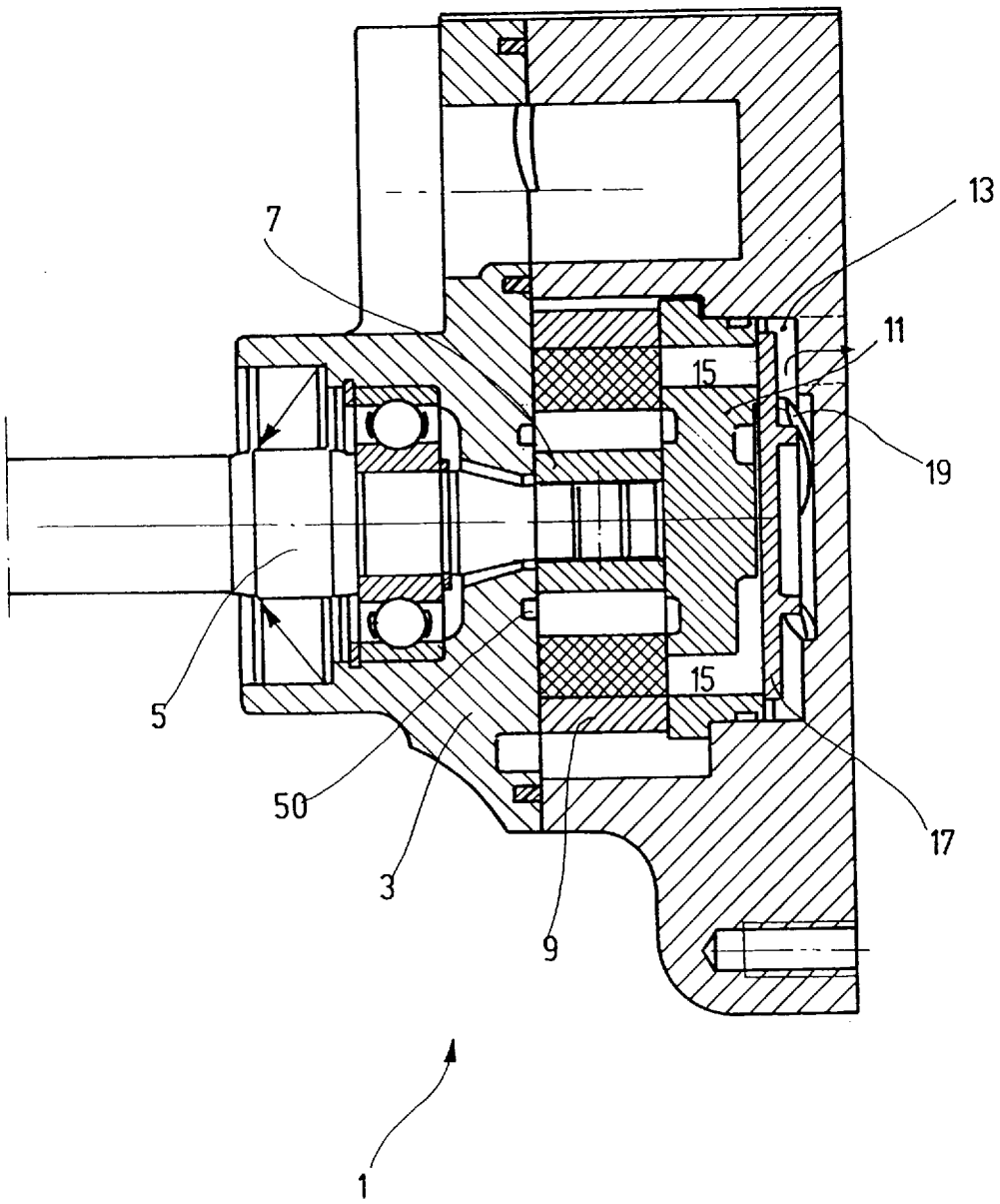

FIG. 1 shows a first example of a pump structured as a vane pump 1, in longitudinal section, in a highly schematic form. It has a base housing 3, penetrated by a drive shaft 57 which engages in a rotor 7. The rotor 7 has slits, which run radially on its circumference surface, with vanes movably arranged in them. The rotor 7 is surrounded by a contour ring 9, the inside surface of which is structured in such a way that at least one, preferably two sickle-shaped transport spaces are formed. The vanes pass through these, resulting in two pump segments each having a suction region and a pressure region.

The rotor 7 and the contour ring 9 rest against a sealing surface of the base housing 3, forming a seal. On the other side of these parts, a pressure plate 11 is provided, through which the fluid transported by the vane pump 1 is guided from the pressure side of the pump to a pressure space 13, which is part of a fluid path leading from the pressure side to a consumer. For this purpose, pressure channels 15 pass through the pressure plate 11; these channels open towards the pressure region of the pump segments on the one side, and towards the pressure space 13 on the other side.

The transport openings of the pressure channels 15, which open into the pressure space 13, are closed off by a seal element, which is designated and structured as a cold-start plate 17 here; this plate is pressed against the pressure plate 11 with a pre-load force by a contact spring 19, for example a Belleville spring washer.

From the pressure space 13, the fluid transported by the vane pump 1, preferably oil, reaches a consumer, for example, a power steering mechanism or a transmission.

Figure 2:
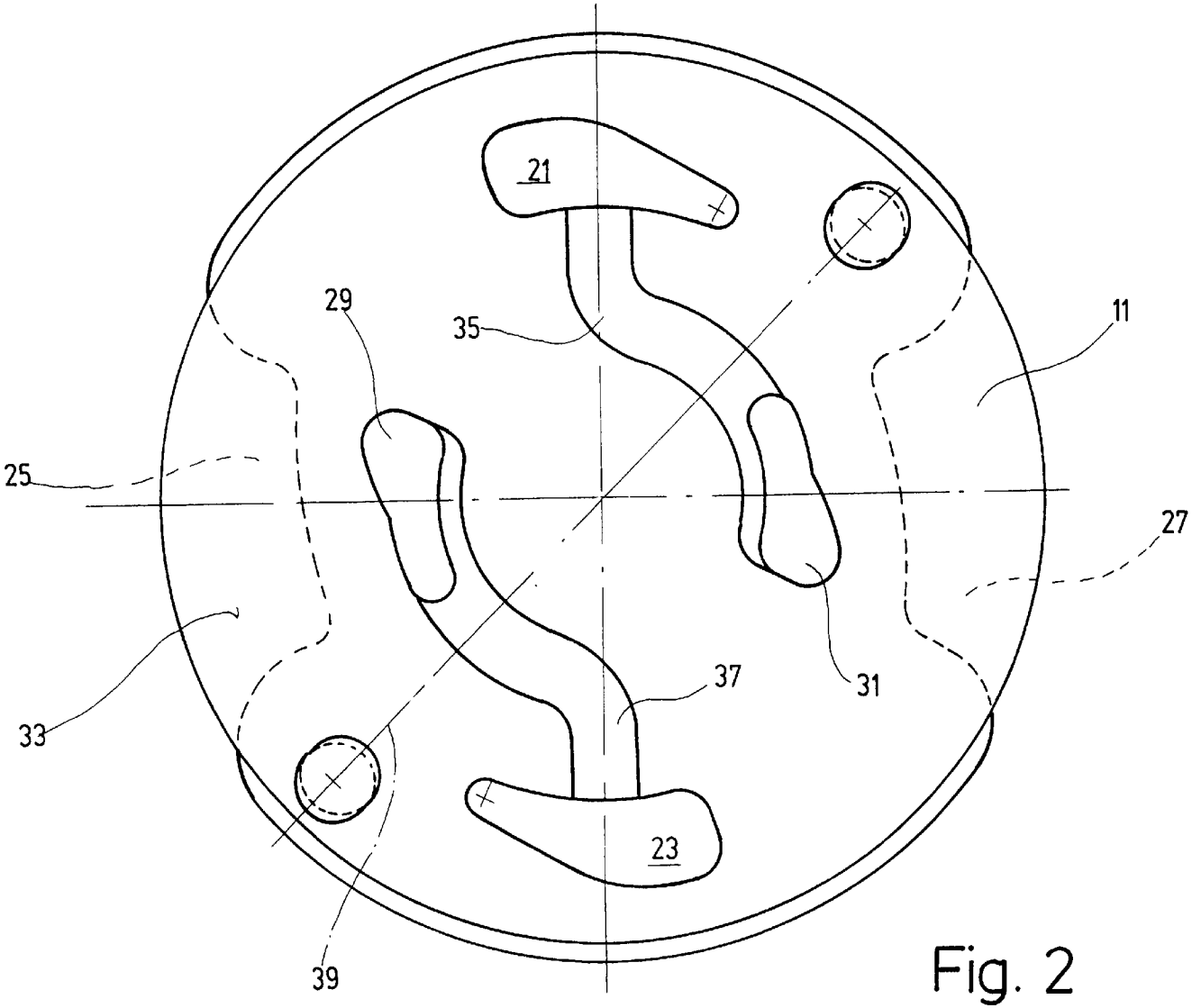
FIG. 2 shows a top view of a first embodiment of a surface of a pressure plate, which faces towards the cold-start plate.

FIG. 2 shows a surface 22 of the pressure plate 11, greatly magnified, facing towards the cold-start plate 17, which is not shown in FIG. 2. Here, two kidney-shaped transport openings 21 and 23 are evident; these lead to the pressure regions of the pump segments via pressure channels 15. Preferably, the pressure channels 15 have a passage surface, which corresponds to a maximum of ⅔ of the passage surface of the transport openings 21, 23.

The pressure region assigned to the transport opening 21 has a suction region 25 of the first pump serpent, indicated here, which belongs to it. Analogously, the pressure region belonging to the transport opening 23 has the suction region of the second pump segment assigned to it.

Here, the pressure plate 11 is provided with feed channels, which run essentially perpendicular to the plane of the drawing, through which the fluid, that is, hydraulic oil reaches the bottom vane region of the pump segments. Here, a first feed opening 29 is evident, into which the feed channel of the first bottom vane segment opens. Also evident is a second feed opening 31, into which the feed channel in the pressure plate surface 33 assigned to the second bottom vane region opens.

FIG. 2 shows that grooves 35 and 37 are made in the pressure plate surface 33, to serve as fluid connections. The first groove 35 runs from the transport opening 21 to the feed opening 31, the second groove 37 extends from the transport opening 23 to the feed opening 29. The transport openings of a pump segment therefore each supply the bottom vane region of the other, leading pump segment.

The imaginary separating line between the two pump segments is indicated with a broken diagonal line 39.

FIG. 3 again shows the pressure plate surface 33 of a pressure plate 11. Parts, which agree with those in FIG. 2, are indicated with the same reference numbers, so that no description of them is necessary here.

Here again, fluid connections formed as grooves are made in the pressure plate surface 33, but their progression differs as compared with the one explained using FIG. 2 in that the transport opening 21 does not have any connection to any grooves. Instead, two grooves 37*a* and 37*b* are provided at the transport opening 23, leading to the feed openings 29 and 31. Both bottom vane regions are therefore supplied with hydraulic oil from the transport opening of one pump segment.

Using the basic diagram in FIG. 4, the flow conditions which result when a cold-start plate is applied to a pressure plate, will be explained.

Figure 4:
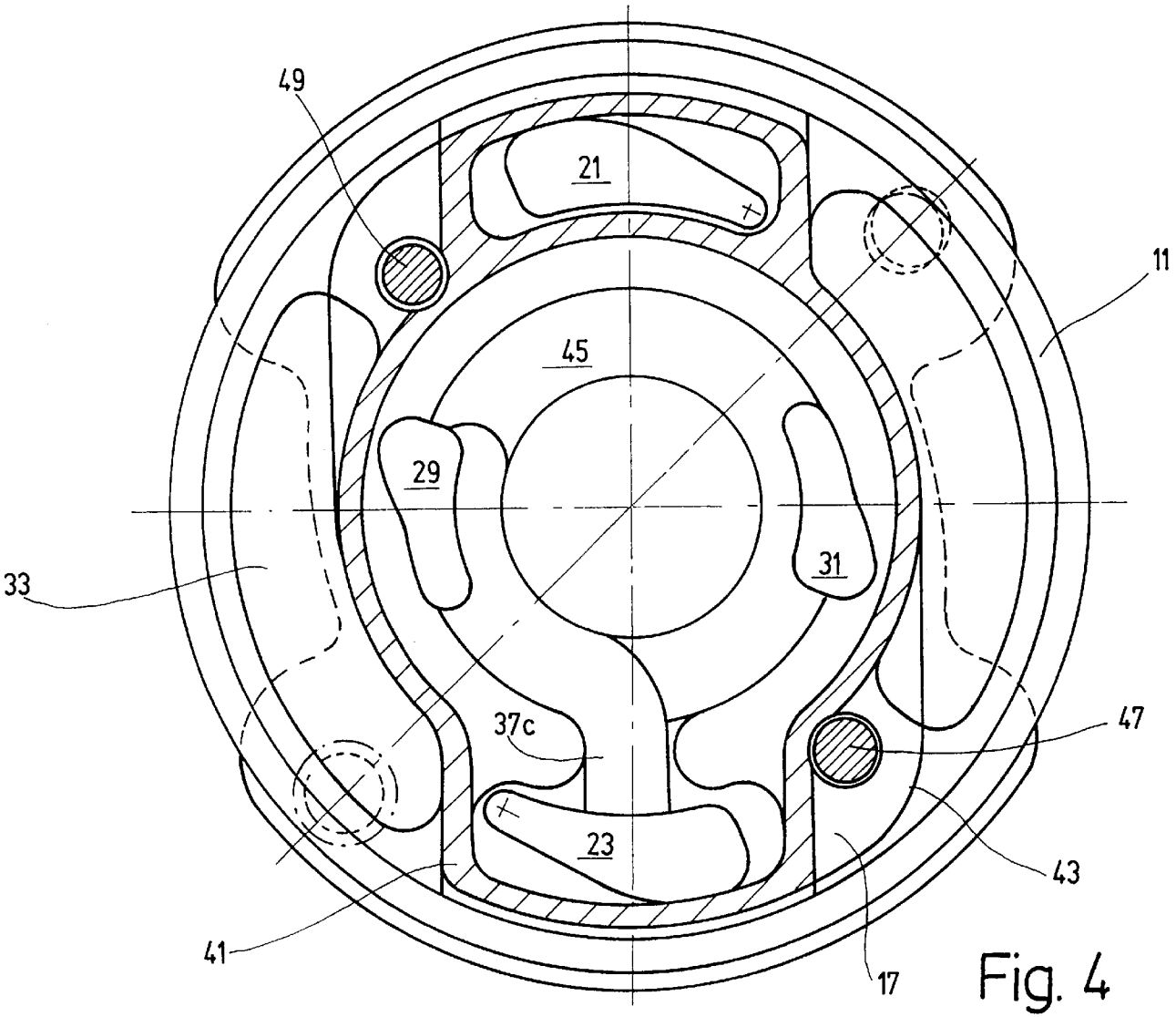
FIG. 4 shows a basic diagram showing the fluid path between a pressure plate and a cold-start plate.

In the representation selected in FIG. 4 the cold-start plate has been removed, in order to make the contours on the pressure plate surface 33 more clearly evident. In FIG. 4, the rest region or contact region 41 between the pressure plate 11 and the cold-start plate 17 is shown with a broken line. It is evident that the contact region between the two plates is significantly smaller than their surface or their total cross-section. The outer contour 43 of the cold-start plate 17 is also indicated in FIG. 4.

It is also evident in FIG. 4 that the pressure plate surface 33 has transport openings 21 and 23 as well as feed openings 29 and 31. In the example of the pressure plate 11 shown here, a fluid connection structured as a channel 37*c* extends from the transport opening 23 to the feed opening 29. The two feed openings 29 and 31 are connected with one another by means of an annular groove 45, which forms a fluid connection with the channel 37*c*. The annular groove 45 is therefore also connected with the transport opening 23 by way of the channel 37*c*, which is formed as a groove.

In the embodiment of the pressure plate 11 shown here, the channel 37*c*, which runs between the transport opening 23 and the feed opening 29, is formed to be deeper than the annular groove 45. For the remainder, it is possible also to form the channel 37*c* in a mirror image and to have it run not to the feed opening 29 but to the feed opening 31.

The contact region 41 is placed in such a way that the pressure regions of the pump segments, which open into the pressure plate surface 33 via the feed openings 21 and 23, are covered towards the outside. The cold-start properties of the pump are already significantly improved, however, if only the transport opening 23 of the bottom pump segment is sealed off by the cold-start plate 17. In this embodiment, it has proven to be particularly advantageous that the noise development can be positively influenced by avoiding undefined fluttering of the cold-start plate.

In addition, in the example of FIG. 4, it is evident that the contact region 41 completely surrounds the feed openings 29 and 31 as well as the transport opening 23, and closes off the fluid pat to the pressure space 13, that is, to the consumer, which arises at the transport opening 21. In this manner, the pressure regions of the vane pump 1 are separated from one another by means of the cold-start plate 17, which rests on the pressure plate 11 and serves as a seal element, that is, as a hydraulic resistance element with an infinite resistance.

In the followings, the function of the vane pump 1, that is, the effect of the seal element structured as the cold-start plate 17, will be discussed in greater detail.

In the rest state of the vane pump 1, the pressure regions of the pump segments as well as the pressure channels 15 are free of pressure, so that the cold-start plate 17 is pressed against the pressure plate 11 by the pressure spring 19. This causes the transport openings 21 and 23 to be closed off relative to the pressure space 13.

When a cold start of the vane pump 1 occurs, in other words when the transported hydraulic oil is very viscous and the vanes are therefore mounted in the slits in the rotor 7 with relatively little mobility, the transport oil exiting from the transport openings 21, 23 in the example according to FIG. 2 is guided through the grooves 35 and 37 to the feed openings 31 and 29, in other words, to the bottom vane regions of the pump segments. This ensures that during a cold start, the vanes are forced outward into their functional position and therefore the suction regions and pressure regions of the pump segments are sealed off relative to one another. Furthermore, this ensures that the vane pump 1 will transport hydraulic oil during a cold start.

Figure 3:
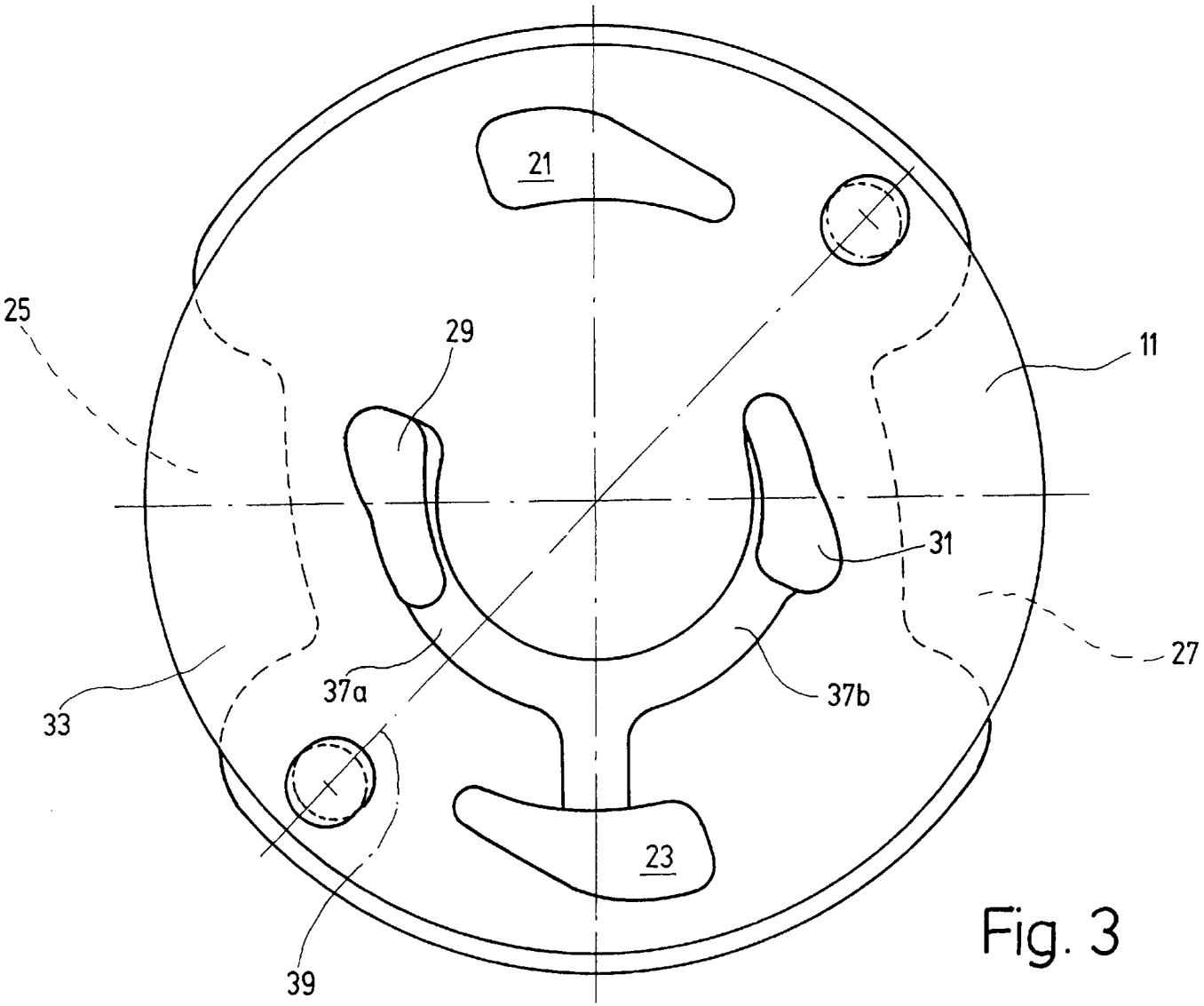
FIG. 3 shows a second embodiment of a surface of a pressure plate, which faces towards the cold-start plate.

In the example shown in FIG. 3, there are no grooves connected with the transport opening 21. Instead, the situation is that the transport opening 23 of the bottom pump segment supplies the bottom vane regions of both pump segments with hydraulic oil. This happens because on the one hand, hydraulic oil exiting from the transport opening 23 through the groove 37*a* reaches the feed opening 29, and, on the other hand, because hydraulic oil exiting from the transport opening 23 through the groove 37*b* is passed to the feed opening 31. Therefore the bottom vane regions of both pump segments are provided with transported oil by means of the hydraulic oil of a single transport opening 23, and therefore have pressure applied to them.

In the example shown in FIG. 4, the hydraulic oil, which is very viscous during a cold start, first reaches the feed opening 29 through the channel 37*c*, since the larger transport cross-section exists here. An essentially smaller proportion of the transported oil is transported to the feed opening 31 through the annular groove 45, since here there is a greater hydraulic resistance, due to the lesser depth of the annular groove 45. At first, therefore, hydraulic oil is supplied to the bottom vane region of the suction region ahead of the transport opening 23. The definition of the term "ahead of/leading"assumes that the rotor turns in the clockwise direction in all the embodiments shown in FIGS. 2 to 4.

Because the cold-start plate 17 is pressed against the pressure plate 11, forming a seal, at first only the bottom vanes are supplied during a cold start. This means that no hydraulic oil is supplied to the pressure chamber 13 and therefore to a consumer and, instead, the hydraulic oil exclusively ensures proper function of the vane pump 1.

As soon as the vane pump 1 is able to build up a higher pressure, the cold-start plate 17 lifts off from the pressure plate 11, counter to the force of the pressure spring 19, so that the two transport openings 21 and 23 are released and the transported oil can reach the consumer, via the pressure space 13.

The contact region 41 is selected to be as small as possible, so that the cold-start plate 17 does not adhere to the pressure plate 11, and also this prevents the hydrodynamic paradox from going into effect and the cold-star plate 17 from being drawn towards the pressure plate 11 by outflowing oil.

As mentioned above, it becomes clear that proper function of the cold-start plate 17 is only guaranteed if the orientation relative to the pressure plate 11, as shown in FIG. 4, is guaranteed. Therefore the cold-start plate 17 has to be both centered and prevented from rotating, for example, by means of pins 47 and 49, which are shown in FIG. 4. Preferably, the pins already used for centering the pressure plate and the contour ring are structured to be lengthened, so that they can engage in corresponding, bores in the cold-start plate 17. However, it has proven to be particularly advantageous to use the pins 47, 49 also for centering the pressure spring 19. Because the pins penetrate the cold-start plate 17 and interact with the spring, the pins, which are already present in vane pumps, can be used for an additional function. Consequently, no additional parts have to be provided for centering the spring.

Because the transport opening 21 is closed off to be pressure-tight relative to the transport opening 23, the oil transported via the feed opening 23 by the bottom pump segment during a start is prevented from entering into the transport opening 21 of the top pump segment and, from there, getting back directly into the suction region of the top pump segment, because the vanes are retracted, without being able to build up the pressure required for supplying the bottom vane regions.

To support the cold-start properties, a continuous circumferential groove, indicated as 50 in FIG. 1, which is arranged on the side of the rotor 7 opposite the pressure plate 11, can be divided in two by hydraulic resistances, for example ridges, with one region of the groove 50, in each instance, being assigned to a bottom vane region of a pump segment. This ensures that hydraulic oil supplied to a bottom vane region during a cold start will not flow off to the bottom vane region of the other pump segment, which does not yet demonstrate a transport function. The important thing in this connection is that the hydraulic resistance between the suction region and the pressure region of a pump segment is greater than it is between these regions and the suction region and pressure region of the other pressure region [sic] of the pump.

From the description relating to FIGS. 1 to 4, it is clearly evident that the fluid connections provided in the pressure plate surface 33, formed as grooves 35, 37, 37*a*, 37*b*, 37*c*, can also be made in the surface of the cold-start plate 17, which faces the pressure plate 11. Furthermore, it is also possible to provide grooves to supply the bottom vane region both in the pressure plate surface 33 and in the cold-start plate 17. The important thing is that the pressure regions of the vane pump 1 are separated from one another and, here also, from the pressure space 13, during a cold start, and that purely bottom vane operation is guaranteed, in which the hydraulic oil transported during the start phase is supplied exclusively to the bottom vane regions.

The cold-start plate 17 can be made from a suitable metal or plastic. The pressure force of the pressure spring 17 [sic] can be coordinated with the operating behavior of the vane pump 1 in an individual case. It is also possible to guarantee the pressure force, which acts on the cold-start plate by means of the pressure spring, which presses the pressure plate against the rotor 7.

In all, it also becomes evident that the bottom vane region belonging to the transport opening 23, which lags behind, can be supplied with hydraulic oil via the feed opening 31 and/or that the leading bottom vane region of the other pump segment can be provided with hydraulic oil via the feed opening 29. It is therefore also possible that both bottom vane regions have oil applied to them, where different transport outputs can be distributed among the bottom vane regions by means of different groove cross-sections. With such a structure, oil can also be transported via an empty suction pipe. The pump cam therefore transport air in the startup phase, with the cold-start or startup properties of the pump being significantly improved by the hydraulic resistance element (seal element) referred to as a cold-start plate, also in this case. In this instance, air is supplied to the bottom vane regions when the pump starts up.

Figure 5:
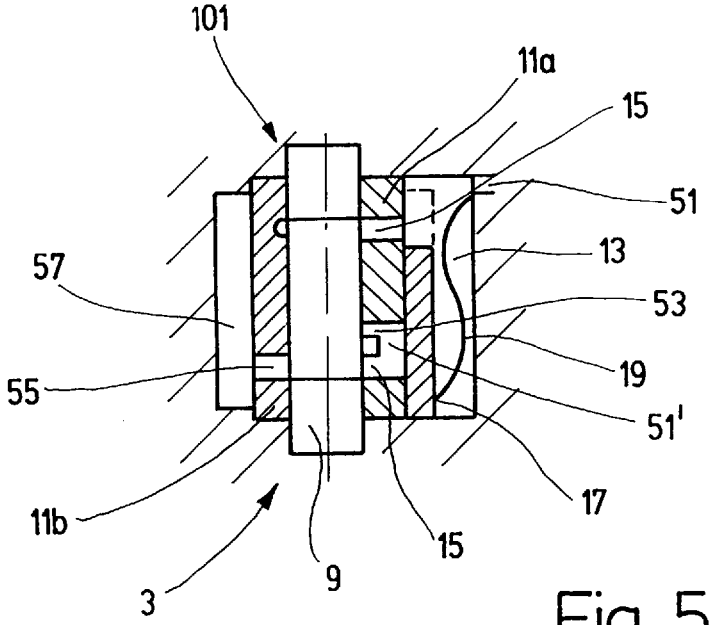
FIG. 5 shows a basic diagram of a second example of a vane pump.
Figure 6:
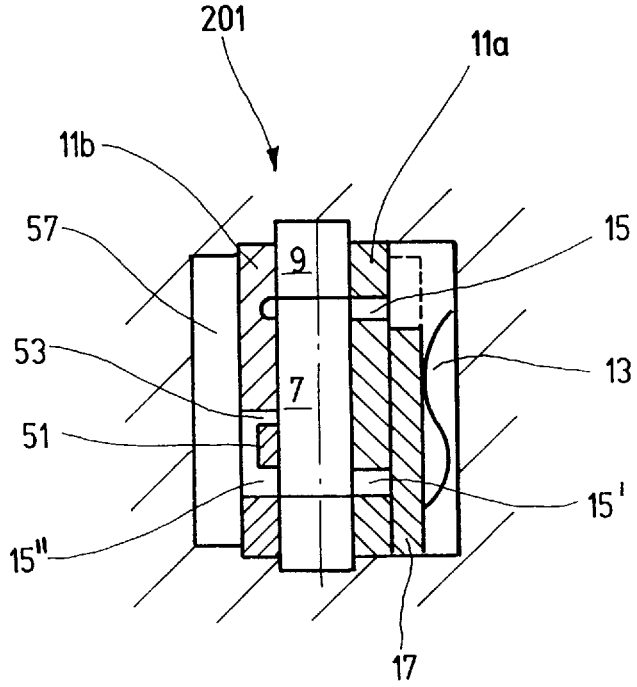
FIG. 6 shows a basic diagram of a third example of a vane pump.

Using the following FIGS. 5 and 6, examples of pumps, which have two pressure plates, are described. Here, as in the examples shown in FIGS. 1 to 4, these are two-stroke vane pumps. The same parts, which were already explained in connection with FIG. 1, have the same reference number, so that no description of them is necessary here.

The vane pump 101 shown in FIG. 5 has a rotor 7 housed in a base housing 3, which is mounted to rotate within a contour ring 9. From the cross-sectional drawing in FIG. 5, it is evident that pressure plates 11*a* and 11*b* are provided at both end faces of the rotor 7 and the contour ring 9. The right pressure plate 11*a* is identical in structure with the example explained in connection with FIG. 1. It has two pressure channels 15, which pass through the pressure plate, opening into a pressure space 13, via feed openings explained in FIGS. 2 to 4, to which space a consumer can be connected in suitable manner, for example, by means of a connection 51. A seal element designated as a startup or cold-start plate 17 rests on the surface of the pressure plate 11*a* facing away from the rotor 17 [sic], closing off the bottom pressure channel 15 of the bottom pump segment of the pump 101. The bottom pressure channel 15 is connected with the bottom vane region 53 of the bottom and/or the top pump segment via a suitable fluid connection 51', which was explained in detail in connection with FIGS. 2 to 4. The cold-start plate 17 closes off the fluid connection 51' relative to the pressure space 13, so that any fluid exiting from the fluid connection 51' reaches the bottom vane region 53 while the pressure channels 15 rests against the pressure plate 11*a*, forming a seal. Although the cold-start plate does not close off the top transport opening of the top pump segment, no transported fluid can get from the bottom pressure channel 15 to the top pressure channel 15 via the pressure space 13. It is therefore possible to make the cold-start plate 17 so small that it only closes off the transport opening of the bottom pump segment relative to the pressure space.

On the left side of the rotor 7, that is, of the contour ring 9, a second pressure plate 11*b* is provided, which has a passage 55 to a sealed space 57 assigned to the pressure region of the bottom pump segment. Fluid transported through the passage 55 to the space 57 results in excess pressure in this space, so that the left pressure plate 11*b* is pressed against the rotor and the contour ring, forming a seal.

When the pump 101 starts up, fluid exiting from the pressure region 15' will reach the space 57 via the passage 55, and also reach the bottom vane region 53 of the bottom and/or top pump segment via the pressure channel 15" and via the fluid connection 5'. When this happens, because of the effect of the seal element, which is referred to and structured as a cold-start plate 17 here, no fluid can get from the pressure channel 15' into the pressure space 13, or into the fluid path to the consumer and to the top pressure kidney 15. It is evident here that the seal element can be structured in practically any desired manner. The only important thing is that the fluid path to the consumer must be interrupted and that the fluid transported by the pump 101 exclusively benefits the bottom vane region during the startup phase, that is, during a cold star.

This also holds true for the example of a vane pump 201 shown in Figure 6, which is also structured as a two-stroke pump with two pressure plates 11*a* and 11*b*, which, as is evident from the cross-sectional view according to FIG. 6, rest against the end faces of a rotor 7, that is, a related contour ring 9. Here again, the same parts have the same reference numbers, so that reference can be made to the description according to FIG. 5 and the one according to FIG. 1.

Here, the left pressure plate 11*b* has a pressure channel 15", which forms a fluid connection with a bottom vane region 53 via a fluid connection 51. Here, the fluid connection does not have to be terminated, since both the pressure channel 15" and the bottom vane region 53 open into the space 57, which is sealed off pressure-tight. The pressure plate 11*a* has a pressure channel 15', which is arranged on the right side of the rotor here, and is sealed off relative to the pressure space 13 by the seal element, which here again is structured as a cold-start plate. In this connection, it can be assumed that FIGS. 5 and 6, just like the other FIGS. 7 to 9 and 1 represent pumps which are in their startup or cold-start phase, during which the transported pressure is not sufficient to lift the seal element that is, the cold-start plate 17, up from the related pressure plate.

From FIG. 6, it is evident that for the method of functioning of the pump, it is not necessary in all cases to close off both of the transport openings assigned to the pressure regions of the two-stroke pump. Instead, it is sufficient to close off only the bottom pressure channel relative to the pressure space, and thereby to block off a fluid connection to the top pressure space, that is, to a consumer. In the startup or cold-start phase, a cold-start plate 17 hydraulically separates the transporting pressure kidney of the pump from the non-transporting one. At the same time, the transported fluid is prevented from flowing out of the transporting pressure kidney, for example getting to a consumer via the pressure space. In addition, it is ensured that the transporting pressure kidney is connected with at least one bottom vane region of the pump, in order to ensure that the vanes, or the rollers, are moved outward against the contour ring, so that the transport properties of the pump during the startup phase are improved.

In the example of the pump 201 shown in FIG. 6) the cold-start plate 17 ensures that no hydraulic oil will reach a consumer via the pressure space 13 during the startup or cold-start phase. The transported oil is instead transported to the sealed space 57 via the left pressure channel 15", and reaches the bottom vane region 53 of the bottom pump segment via a fluid connection which is formed as a groove in the pressure plate 11*b* here, only as an example. In the example shown in FIG. 6, the fluid connection does not have to be made as a groove in the surface of the pressure plate 11*b*, since a fluid connection exists from the bottom pressure channel 15" to the bottom vane region 53, via the hermetically sealed space 57.

Using FIGS. 7 to 9, it will be explained that the principle of improving the startup or cold-start properties as described here represents a significant improvement also for single-stroke pumps, in other words both for vane pumps and for roller pumps. The basic principle of a single-stroke pump 301 becomes evident from the top view of a rotor 7 and a contour ring 9 which is shown in highly schematic form in FIG. 7. The rotor is provided with slits 59 which run axially, and in which vanes 61, used here as an example, are movably mounted. The rotor is eccentrically mounted in the contour ring 9, so that a practically sickle-shaped transport space 63 is formed, through which the vanes 61 pass, here in the counterclockwise direction. This results in a suction region 65 and a pressure region 67, because of the partial volumes separated by the vanes. In the pressure plate resting on the end face of the rotor 7, that is, on the contour ring 9, essentially ring-shaped circumferential grooves 69 and 71 are provided, these are assigned to the bottom vane regions.

Figure 7:
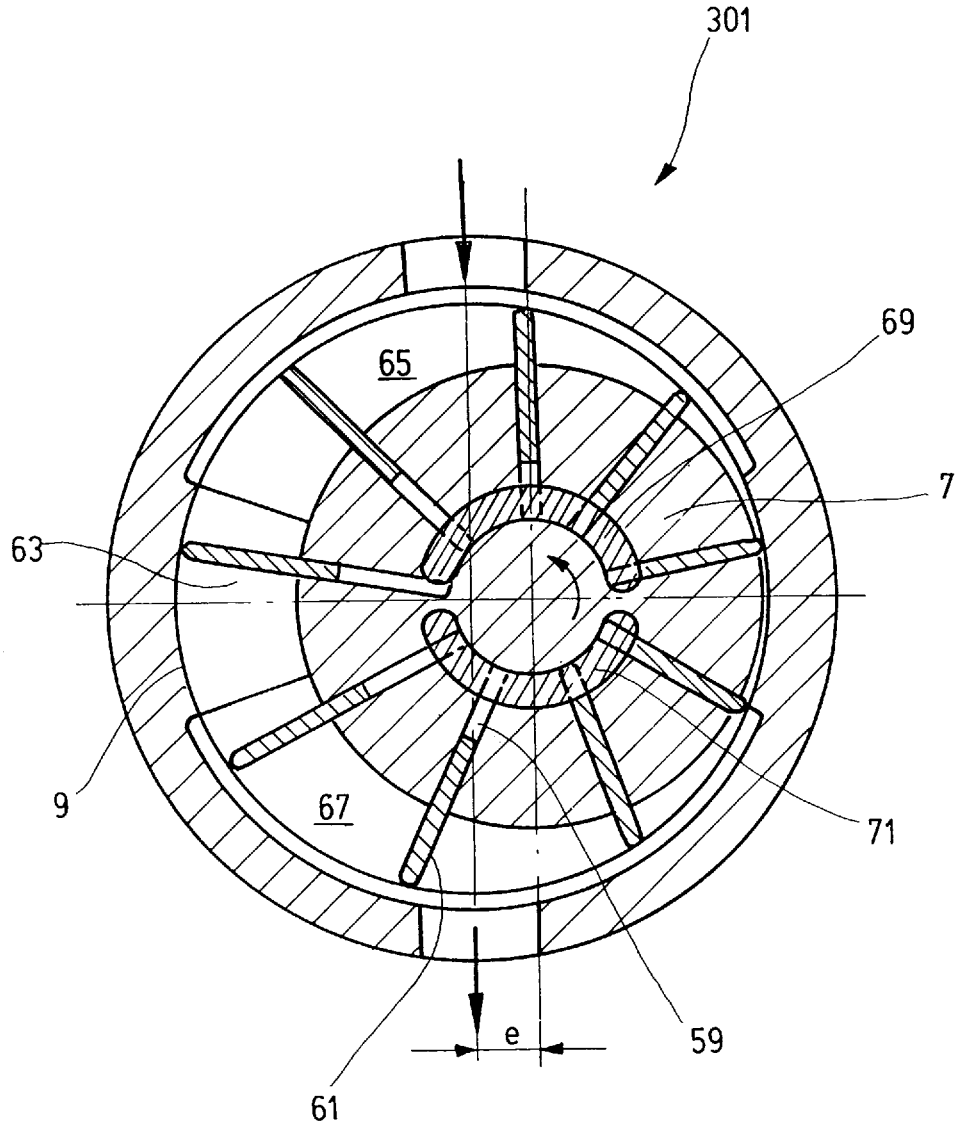
FIG. 7 shows a basic diagram of a single-stroke pump.
Figure 8:
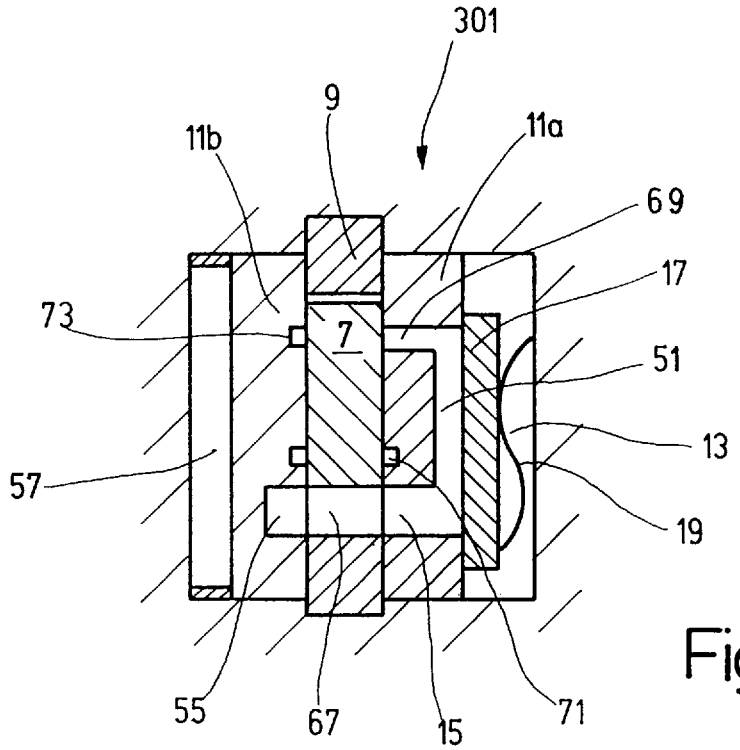
FIG. 8 shows a basic diagram of a cross-section of a single-stroke pump shown in FIG. 7.

FIG. 8 shows a first embodiment of the pump 301 discussed in FIG. 7, with two pressure plates 11*a* and 11*b*, which are arranged to the right and the left of a rotor 7 and a contour ring 9 assigned to the latter. In the embodiment according to FIG. 7, the right pressure plate 11*a* is provided with the grooves 69 and 71, with the groove 69 assigned to the suction region 65 forming a hydraulic connection with the pressure region, that is, with a pressure channel 15 assigned to the pressure region, via a fluid connection 51. Here, the fluid connection 51 is formed as a groove made in the surface of the pressure plate, located in the surface of the pressure plate which faces away from the rotor 7. The fluid connection 51 between the pressure channel 15 and the groove 69 is closed off by means of a seal element structured as a cold-start plate 17, so that fluid exiting from the pressure channel 15 cannot get into the pressure space 13. The cold-start plate 17 is pressed against the pressure plate 11*a* by a pressure spring 19.

Opposite the pressure plate 11*a*, on the other side of the rotor 7 or the contour ring 9, there is a second pressure plate 11*b* which has a circumferential groove 73 which connect the bottom vane regions of both the suction region 65 and the pressure region 67 with one another. The vanes, which move in in the pressure region, supply hydraulic oil to the vanes which move out in the suction region 65, increasing the functional reliability of the pump.

The pressure region 67 of the pump 301 can be connected with a sealed space 57 via a passage 55. This ensures that the left pressure plate 11*b* will be pressed against the rotor 7 and the contour ring 9, and that leakage is reduced to a minimum.

From FIG. 8, it is evident that the left pressure plate 11*b* can be eliminated and that a sealing surface resting against the rotor and the contour ring can be formed directly by the housing here. If, however, the pump 301 is formed as a pump with two pressure plates, it is advantageous if the passage 55 penetrates the pressure plate, so that oil can get into the space 57 and the pressure plate is pressed against the rotor.

From FIG. 8, it becomes clear that in the startup phase, the fluid cannot get from the pressure region 67 to the pressure space 13, that is, to the consumer, via the pressure channel 15. The transported fluid is available exclusively to the bottom vane region of the suction region 65, via the fluid connection 51, so that the transport properties of the pump during the startup or cold-start phase are significantly improved.

Figure 9:
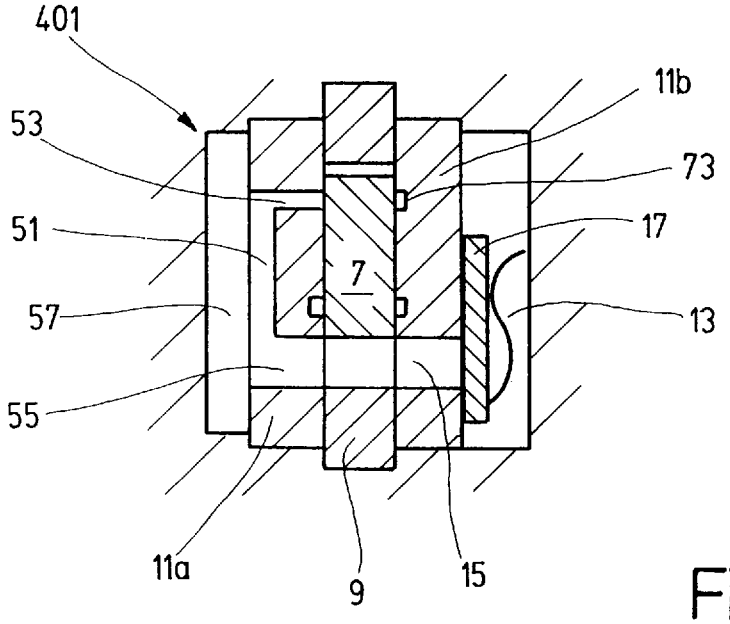
FIG. 9 shows a basic diagram of another example of a single-stroke pump.

Finally, FIG. 9 shows another example of a pump 401, in which the pressure plates 11*a* and 11*b* of the pump explained on the basis of FIG. 8 are interchanged. The same parts are therefore indicated with the same reference numbers. The pressure channel 15 of the right pressure plate 11*b* is closed off by a seal element, here by means of a cold-start plate 17. It becomes clear that the pressure channel 15 can be closed off by any desired seal element. On the side of the rotor 7 opposite the pressure channel 15, a passage 55 is provided, which opens into a hydraulically sealed space 57 and thereby produces a fluid connection with a bottom vane region 53 assigned to the suction region 65. Since the pressure channel 15 is closed off relative to the pressure space 13 during the startup or cold-star phase of the pump 401, the fluid transported during the startup phase exclusively reaches the bottom vane region 53, via the passage 55 and the fluid connection which is represented, as an example, by the space 57. Here, the left pressure plate 11*a* can also have a fluid connection 51 formed as a groove, as it was provided in the pressure plate 11*a* of the pump 301 according to FIG. 8.

The pressure plate 11*b* again is provided with a circumferential groove 73.

It becomes clear that in the example according to FIG. 9, fluid present in the pressure region 67 cannot reach the consumer during the startup or cold-start phase. The seal element, that is, the cold-start plate 17, ensures that the fluid is exclusively available to the bottom vane region 53 of the suction region 65, so that the transport properties of the pump 401 are very rapidly improved.

Figure 10:
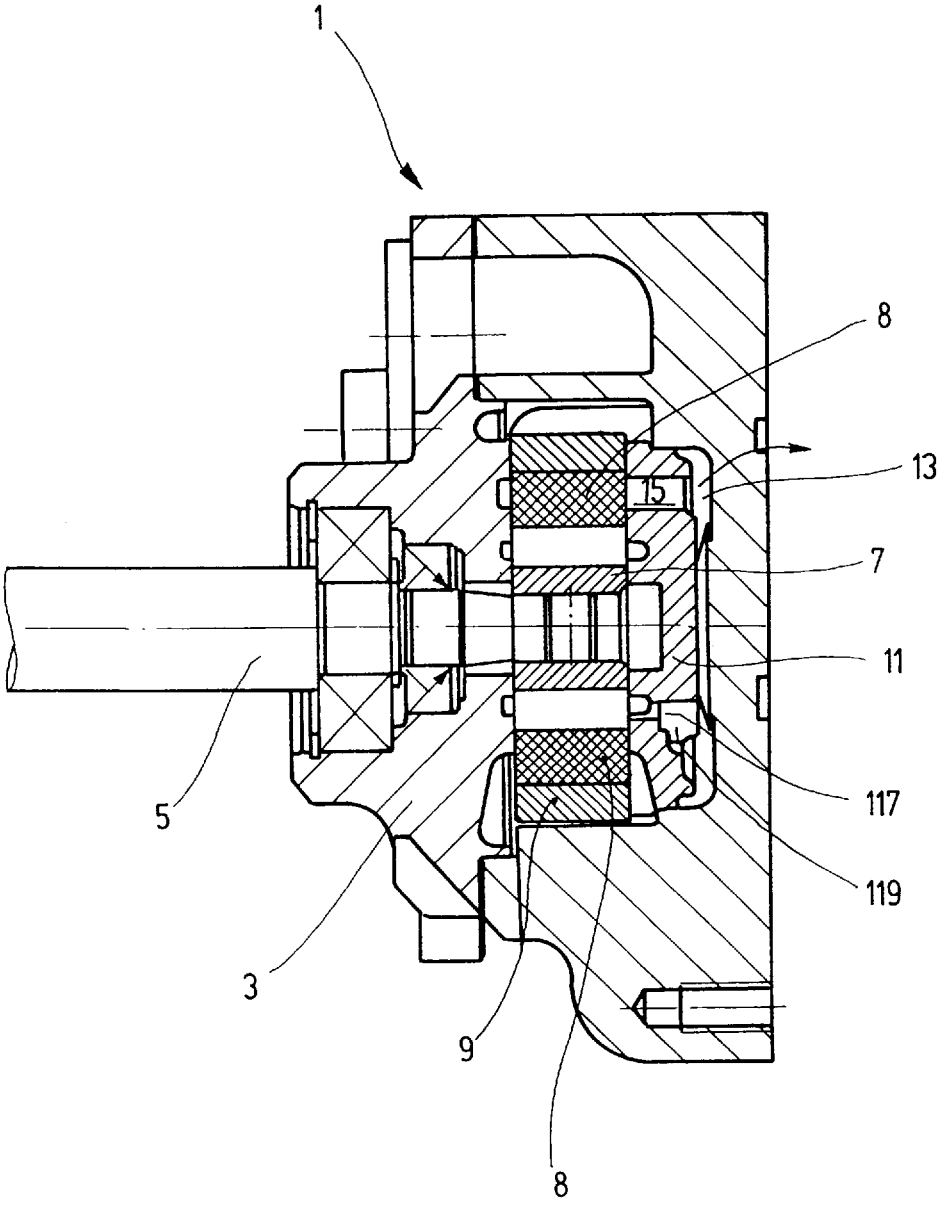
FIG. 10 shows a basic diagram of another example of a vane pump.

FIG. 10 shows another example of a two-stroke vane pump 1 in longitudinal section, where the top half shows a cross-section through the pressure region and the bottom half shows a cross-section through the suction region. The vane pump essentially corresponds to the one shown in FIG. 1, so that the parts marked with the same reference numbers will not be described again The essential difference as compared with the pump shown in FIG. 1 lies in the fact that in this example, the cold-start plate as a hydraulic resistance element with infinite resistance is replaced by a hydraulic resistance element with finite resistance.

Another difference can be seen in the structure of channels 117, which open out into bottom vane regions, not shown, on the side facing towards the rotor, and into the pressure space 13, that is, into the pressure channels 15, on the opposite side. For a better connection between the pressure channel 15 and the channel 117 in each instance, grooves 119 essentially corresponding to the grooves 35, 37 of the preceding examples are made in the surface of the pressure plate 11.

From FIG. 10, it is not evident hat the hydraulic resistances of the fluid paths between the pressure region and the bottom vane region, on the one hand, and between the pressure region and the consumer, on the other hand, are designed differently for a viscous fluid. Thus, for the pressure plate shown in FIG. 2, applied to the example according to FIG. 10, the hydraulic resistance of the connection between the transport opening 21 or 23 and the feed opening 29 or 31, respectively, is less than the hydraulic resistance between the transport opening 21 or 23 and the consumer, or the opposite transport opening 23 or 21 via the pressure space 13. Of course the same holds true also for the pressure plate shown in FIG. 3, if it is used in this example.

This design of the hydraulic resistances, according to the invention, has the result that the cold, viscous fluid first takes the path of least resistance and in this way preferably flows from the pressure regions into the bottom vane regions.

In the following, the function of the vane pump 1, that is, the effect of the aforementioned design of the hydraulic resistances will be discussed in greater detail.

As already mentioned, during a cold start of the vane pump 1, in other words when the transported fluid is very viscous and the vanes are therefore mounted in the slits in the rotor 7 with relatively little mobility, only the bottom pump segment will transport fluid, since the vanes do not rest against the contour ring in the top pump segment In order to also press the vanes in the top pump segment out of the slits, against the resistance of the viscous fluid, the transport output of the bottom pump segment is utilized to supply the bottom vanes of the top pump segment For this purpose, the transported fluid flows through the transport opening 23 and the groove 119, via a pressure channel 15, to the feed opening 29, and through the feed channel 117 into the bottom vane region. The pressure built up in this bottom vane region in this way causes the vanes to be pressed out.

Using the design of the hydraulic resistances as mentioned, it can be guaranteed that the fluid transported by the bottom pump segment essentially entirely benefits the bottom vane region, and does not flow back into the suction region, that is, to the consumer, via the pressure space 13 and the pressure channel 15 of the top pump segment. In this case, no pressure could be built up.

As soon as the pump is yielding its full transport output and the fluid has become warm and therefore less viscous, the hydraulic resistances as stated no longer have any influence on the functioning of the pump.

The pressure plates shown in FIGS. 2 and 3 do not differ in the method of functioning when used in the vane pump according to FIG. 10. However, the separate groove path shown in FIG. 2 has the advantage that the function is independent of the installation position of the pump. For example, the top pump segment can also be at the bottom in the installed state. This is not possible with the embodiment shown in FIG. 3, since then the top pump segment, which is not working, would be responsible for supplying the bottom vanes, but is not designed to do so.

As already explained above, it makes no difference, also in this example, whether the grooves are provided in the pressure plate surface or in the adjacent housing wall. A combination of grooves both in the pressure plate and in the housing wall would also be possible. The only important thing is that the hydraulic resistance between the pressure region and the bottom vane region is clearly less for a viscous liquid than towards the consumer, that is, towards the other pressure region. In other words, it must be guaranteed in every case that the transported fluid of the bottom pump segment can build up a pressure and does not flow off without pressure.

Figure 11:
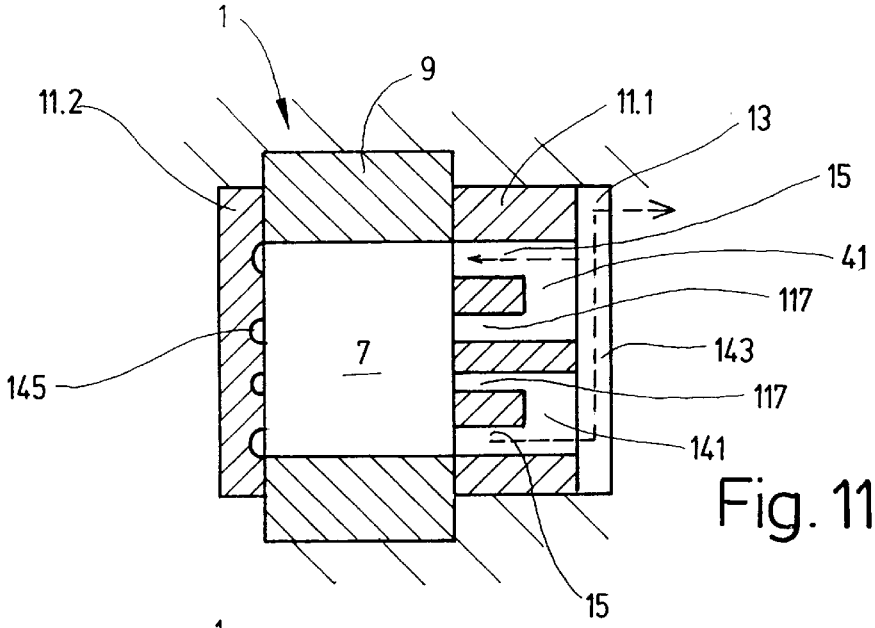
FIG. 11 shows a basic diagram of another example of a vane pump.
Figure 12:
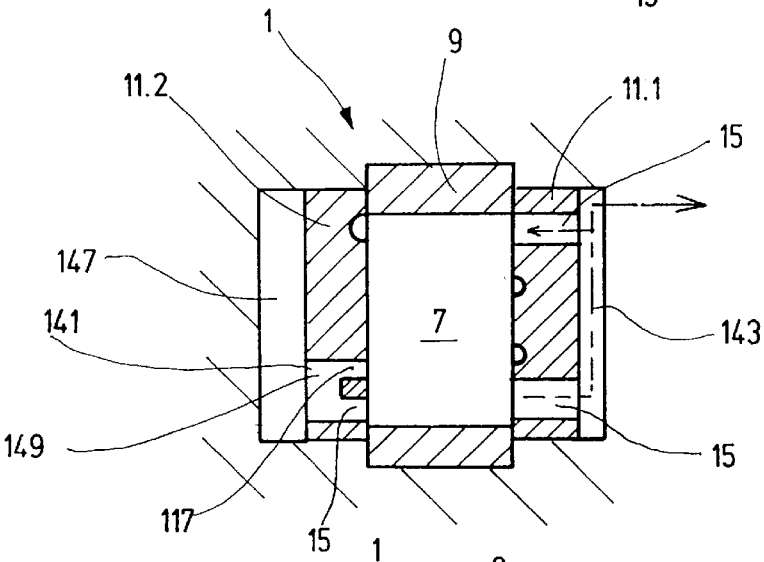
FIG. 12 shows a basic diagram of another example of a vane pump.
Figure 13:
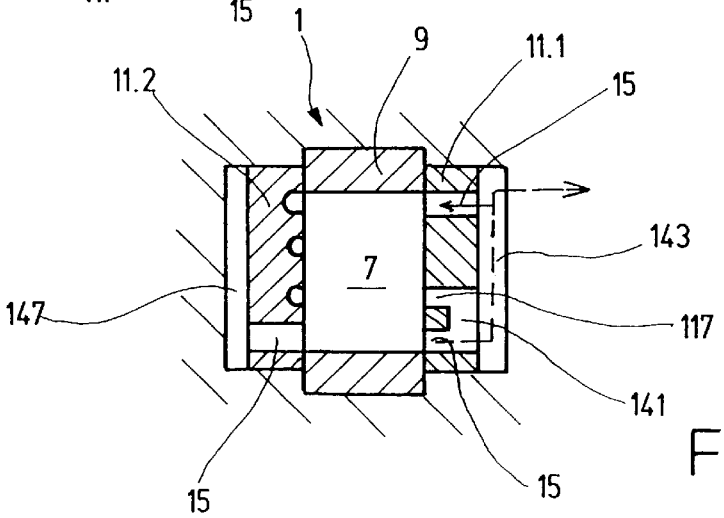
FIG. 13 shows a basic diagram of another example of a vane pump.

FIGS. 11 to 13 show additional examples, which are characterized, as compared with the examples described above, by another pressure plate 11.2. In other words, here again these are two-stroke vane pumps, where the same parts which were already described using FIG. 10 have the same reference numbers, so that they do not need to be described here.

The vane pump 1 shown in Figure 11 also has a rotor 7 housed in a base housing, mounted to rotate within a contour ring 9. From the cross-sectional drawing, it is evident that pressure plates 11.1 and 11.2 are provided at both end faces of the rotor 7 and the contour ring 9. The right pressure plate 11.1 has a structure identical to the example explained using FIG. 10. It has two pressure channels 15 which penetrate the pressure plate, opening into a pressure space 13, to which a consumer can be connected in suitable manner. Using the channels 15 and 117, a fluid path 141 is therefore formed, which serves to supply at least one bottom vane region. A suitable selection of the hydraulic resistance, for example by providing ridges, deeper grooves, throttles, etc., guarantees that the viscous fluid preferably takes this path and not the fluid path 143 shown with a broken line.

In the pressure plate 11.2 which lies opposite the first pressure plate 11.1, a circumferential groove 145 is provided, it serves to supply the bottom vanes. To support the cold-start properties, the continuous circumferential groove 145 can be divided in two by means of hydraulic resistances, for example by ridges, with one region of the groove being assigned to one pump segment in each instance. This ensures that hydraulic oil being transported to a bottom vane region does not flow off to the bottom vane region of the other pump segment, which does not yet exercise any transport function, during a cold start. The important thing in this connection is that the hydraulic resistance of a pump segment is greater than between these regions and the suction region and the pressure region of the other pressure region [sic] of the pump.

FIG. 12 shows another example of a vane pump 1, in which the pressure plate 11.1 only has pressure channels 15. The bottom vane regions are not supplied via this pressure plate. The opposite pressure plate 11.2, in contrast, has not only a pressure channel 15 but also a feed channel 117, in at least one bottom vane region. The pressure channel 15 opens out into a hermetically sealed pressure space 147, into which the feed channel 17 also opens. During operation of the pump, a pressure builds up in this pressure space 147, pressing the pressure plate 11.2 tightly against the contour ring and the rotor, on the one hand, and putting pressure on both bottom vane regions, on the other hand.

Since the pressure space 147 is hermetically sealed, the groove 149 in the second pressure plate 11.2 shown in FIG. 12 can easily be eliminated, as long as there is a guarantee that the hydraulic resistance of the fluid path 141 (pressure region/pressure space/bottom vane region) is less than that of the fluid path 143 between the two pressure regions.

For the remainder, the function of the vane pump shown in FIG. 12 corresponds to that of the examples already described above. However, the pressure plate shown in FIG. 2 cannot be used.

The example of a vane pump 1 shown in FIG. 13 also works in the same way. In contrast to the example shown in FIG. 12, the second pressure plate 11.2 only has a pressure channel 15, which opens out into the hermetically sealed pressure space 147. Here again, a fluid connection between the two pressure regions via the pressure space 147 is precluded. The feed channel 117 which leads to a bottom vane region is again provided in the first pressure plate 11.1. In this case, again, of course the pressure plate 11.2 can be structured in accordance with the examples in FIGS. 2 and 3.

In the example shown in FIG. 13, the problem frequently occurs that air collects in the top region of the pressure space 147, and cannot escape because there are no openings. The collected air results in clearly audible and therefore bothersome noises. This problem can be solved using the examples shown in FIG. 14*a* to 14*c*.

For this purpose, the vane pump shown in FIG. 14*a* has a ventilation channel 165 in the pressure plate 11.2, in addition to the parts already described in detail in connection with the preceding examples. This ventilation, channel passes through the pressure plate 11.2 and opens into a pressure kidney 167, which is assigned to the top pump segment. In order to prevent a fluid flow from the bottom pressure region to the top pressure region from occurring during the cold-start phase, the ventilation channel 165 has a lesser flow cross-section area The hydraulic resistance formed by the ventilation channel 165 therefore has to be selected to be great enough, for cold viscous oil, so that essentially no fluid flow can occur, so that almost all the hydraulic oil transported from the bottom pump segment into the pressure space 147 will benefit the bottom vane region via the channel 145.

FIG. 14*b* shows another implementation, where in this case a ventilation channel 165 is assigned to each of the two pressure kidneys of the pressure plate 11.2. Since two hydraulic resistances in the form of the ventilation channels 165 lie in the fluid path from the bottom pressure region, via the pressure space 147, to the top pressure region, the flow cross-section area of the individual ventilation channel can be designed to be somewhat smaller than in the preceding example. It is only necessary to ensure that the total of the two hydraulic resistances is so great that essentially no fluid flow occurs for cold viscous hydraulic oil during the startup phase.

In both aforementioned examples, the small cross-section of the ventilation channel 165 is sufficient, however, to allow air which flows upward in the pressure space 147 to escape from it.

Another embodiment of a ventilation is shown in FIG. 14*c*. Instead of providing a hydraulic resistance in the form of narrowed channels in the pressure plate 11.2, a ridge 169 is preferably formed on the wall which delimits the pressure space 147. This ridge 169 serves as a hydraulic resistance element placed in the fluid path between the bottom and top pressure region. Its resistance value is again selected to be so great that cold viscous hydraulic oil cannot flow from a pressure space region assigned to the bottom pump segment into a pressure space region assigned to the top pump segment, with the ridge 169 representing the border between the two pressure space regions.

Of course it is also possible to produce two completely separate pressure space regions by structuring the ridge 169 accordingly.

In summary, it can therefore be stated that the examples described in connection with FIGS. 10 to 14 have the common feature that the hydraulic resistance of the fluid path 143 which exists between two pressure regions, that is, the fluid path between the transporting pressure region and the consumer, is designed to be greater than the hydraulic resistance of the fluid path 141 between the pressure region and the bottom vane region. This guarantees, in every case, that when the vane pump starts up, the transporting bottom pump segment will essentially be used to supply the bottom vane regions, in order to thereby increase the transport output of the top pump segment.

Of course other arrangement combinations of pressure channels and feed channels in one or two pressure plates are also possible. For the pump to function according to the invention, all that is actually necessary is to provide the hydraulic resistances in the manner stated.

After all this, it becomes clear that the principle presented here can be used both for vane pumps and for roller pumps. Also, it does not matter whether the pumps are structured as single-stroke or two-stroke pumps, or whether they have more than two transport spaces. The important thing is that at the first moment, in other words during startup or a cold start, the fluid connection between the transporting pressure region and a consumer is greatly restricted or interrupted, that there is also almost no connection between the transporting pressure region and a pressure region which does not perform the transport function at startup, for two-stroke pumps and multi-stroke pumps, and that finally, a hydraulic resistance element with a finite or an infinite resistance ensures that the fluid which is present or transported during the startup phase is preferably or exclusively supplied to a bottom vane region, in order to improve the transport behavior of the pump when it starts.

I claim:

1. A pump comprising:

at least two pump segments, each having a suction region and a pressure region, with a first fluid path leading from a pressure side to a consumer, and with at least one hydraulic resistance element, which is arranged in the first fluid path to the consumer, wherein the hydraulic resistance element that provides hydraulic resistance is arranged in a second fluid path connecting the pressure regions of the at least two pump segments.

2. The pump of claim 1, wherein, during start-up, the hydraulic resistance element is structured with an infinite resistance as a seal element which separates the pressure regions of the pump segments from one another.

3. The pump of claim 1, wherein the pump is a vane pump which has a rotor which comprises slits which run radially and hold vanes, a pressure plate which rests tightly against an end face of the rotor, and a fluid connection between the pressure side of the vane pump and a bottom vane region.

4. The pump of claim 2, wherein the pressure plate is provided with at least one connection.

5. The pump of claim 1, wherein a fluid connection exists from a feed opening (23) to a bottom vane region which follows the transport opening, viewed in the direction of rotation.

6. The pump of claim 1, further comprising a rotor holding a vane and with at least one pressure plate resting tightly against an end face of the rotor, where a third fluid path is formed between a pressure side of the pump and at least one bottom vane region, the hydraulic resistance element is designed in such a way that the hydraulic resistance of the third fluid path is so small, relative to that of the second fluid path, that when cold fluid is transported, a substantial portion of the cold fluid flows through the third fluid path.

7. The pump of claim 6, wherein the pressure plate has a groove on its side facing away from the rotor, which forms the third fluid path together with a transport opening and at least one feed opening in the pressure plate.

8. The pump of claim 7, wherein another pressure plate assigned to the other end face of the rotor is provided, which has a circumferential groove connecting to the bottom vane regions, and that a hydraulic resistance, in the form of a ridge, is provided between a groove region assigned to a first pump segment and a groove region assigned to a second pump segment.

9. The pump of claim 8, wherein a channel which passes through the another pressure plate, which channel produces a fluid connection between a pressure region and a pressure space.

10. The pump of claim 9, wherein the additional pressure plate has another channel which produces a fluid connection between the pressure space and the other pressure region, where a hydraulic resistance element is formed in the fluid path between the pressure regions, via the pressure space, almost entirely preventing a connection when the fluid is cold and viscous.

11. The pump of claim 10, wherein the hydraulic resistance element is provided in the form of a channel which has a smaller cross-sectional area than the flow cross-sectional area.

12. The pump of claim 10, wherein the hydraulic resistance element is provided in the form of a ridge which is arranged in the pressure space.

13. The pump of claim 4, wherein that at least one fluid connection is formed as a groove, on a side of the pressure plate facing the seal element structured as a cold-start plate, by way of which fluid communicates from a transport opening of the pressure side to at least one bottom vane region.

14. The pump of claim 13, wherein the cold-start plate closes off at least one groove in the surface of the pressure plate facing the cold-start plate, relative to the first and the second fluid path, via which the fluid communicates from the transport opening to at least one bottom vane region.

15. The pump of claim 14, wherein a fluid connection exists from a transport opening to a bottom vane region which lies ahead of the transport opening, viewed in the direction of rotation.

16. The pump of claim 15, wherein both the following and the leading bottom vane region with respect to the transport opening form a fluid connection with the transport opening.

17. The pump of claim 13, wherein the fluid connection is implemented by grooves made in the surface of at least one of the pressure plate and the cold-start plate.

18. The pump of claim 17, wherein the grooves are in both the pressure plate and the cold-start plate, a depth of the groove in the pressure plate is different form a depth of the groove in the cold-start plate.

19. The pump of claim 13, wherein the cold-start plate is pressed against the pressure plate by a pre-load force.

20. The pump of claim 19, wherein the pre-load force is selected to be such that the cold-start plate lifts up after start-up and opens the connection of the pressure regions to the consumer.

21. The pump of claim 20, further comprising two pins which center the pressure plate, the pins are structured in such a way that they both center the cold-start plate alone or the cold-start and the spring and secure the cold-start plate against rotation.

22. The pump of claim 19, wherein the pre-load force is applied by a spring.

23. The pump of claim 19, wherein the pump is a roller pump.

24. The pump of claim 13, wherein at least one of the pressure plate and the cold-start plate is structured in such a way that an area of contact region between the plates is a minority portion of a sectional area of the plates.

* * * * *